US005544378A

United States Patent [19]

Chow

[11] Patent Number: 5,544,378

[45] Date of Patent: Aug. 13, 1996

[54] INFLATABLE PILLOW

[76] Inventor: Pok Y. J. Chow, 12/F., Union Industrial Bldg. 116Wai Yip Street, Kwun Ton, Kln, Hong Kong

[21] Appl. No.: 487,805

[22] Filed: Jun. 7, 1995

[51] Int. Cl.[6] ..... A47C 7/38

[52] U.S. Cl. ..... 5/644; 5/640; 297/397

[58] Field of Search ..... 5/640, 644, 645; 297/397

[56] References Cited

U.S. PATENT DOCUMENTS

| | | | |
|---|---|---|---|
| 305,428 | 9/1934 | Covert | 5/644 X |
| 2,589,155 | 3/1952 | Smith | 5/644 X |
| 2,728,926 | 1/1956 | Emery | 5/644 |
| 3,115,647 | 12/1963 | Emery | 5/644 |
| 4,031,578 | 6/1977 | Sweeney et al. | 5/644 X |
| 4,285,081 | 8/1981 | Price | 5/644 X |

FOREIGN PATENT DOCUMENTS

| | | | |
|---|---|---|---|
| 2194883 | 3/1983 | United Kingdom | 5/644 |

*Primary Examiner*—Michael F. Trettel
*Attorney, Agent, or Firm*—Dressler, Goldsmith, Shore & Milnamow, Ltd.

[57] ABSTRACT

An inflatable pillow comprising end sections and an intermediate portion. Valve means for inflating the pillow is connected to one of said end sections and passages are provided interconnecting said end sections to simultaneously inflate the pillow. The pillow further includes an intermediate trapezoidal section containing a relatively flat portion at its upper end and an inflatable portion at its lower end that is a fraction of the height of the inflatable end sections. A strap means is provided to secure the pillow to a back rest to provide stability of the pillow when in use.

2 Claims, 1 Drawing Sheet

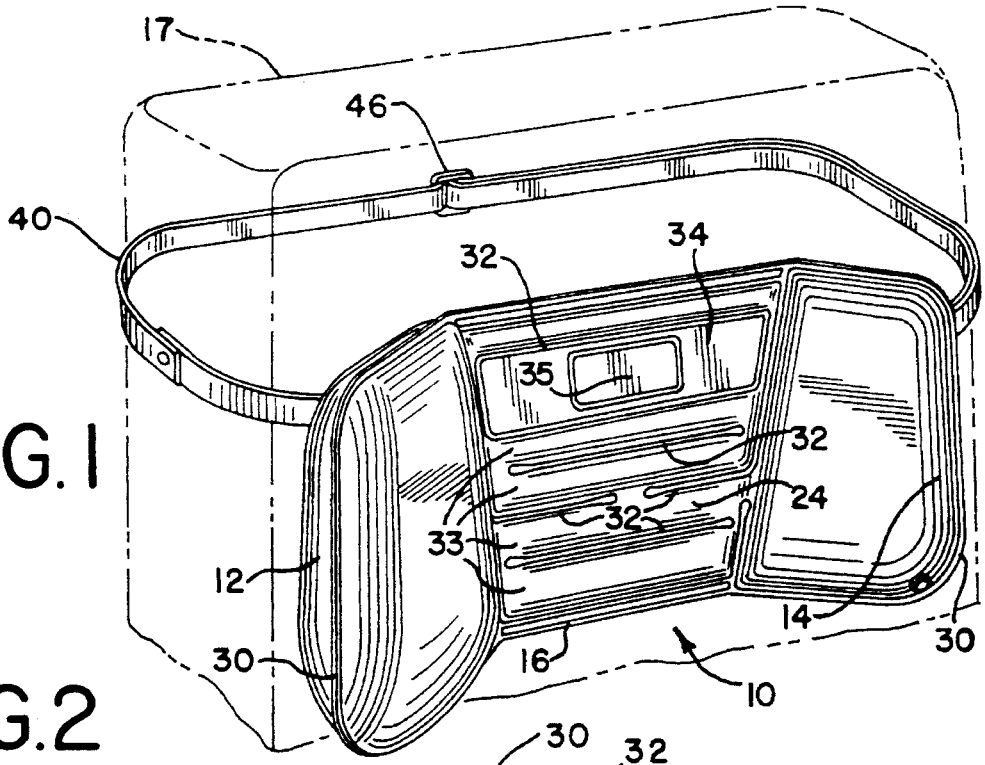
FIG. 1
FIG. 2
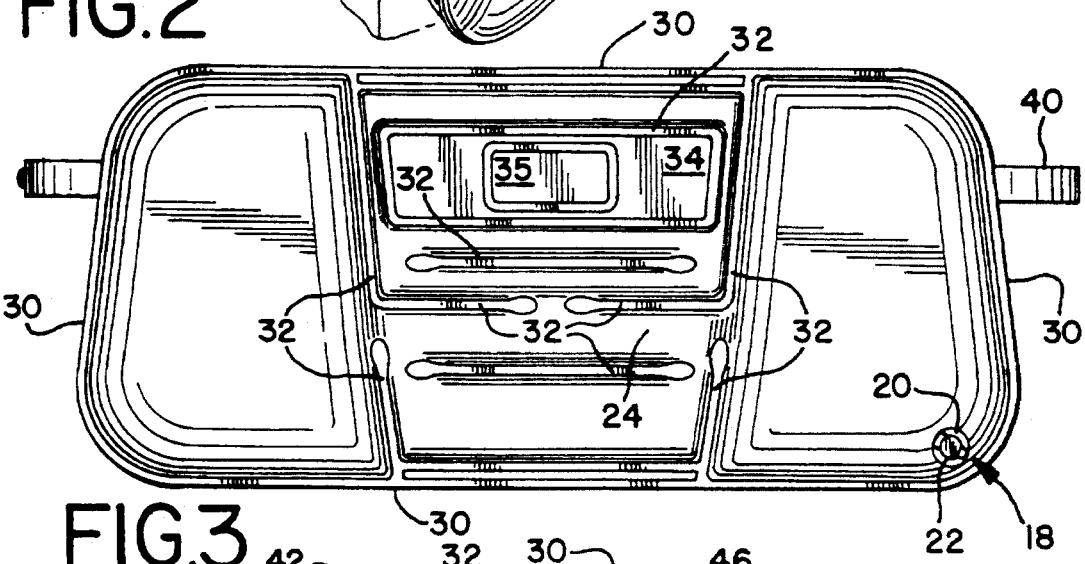
FIG. 3
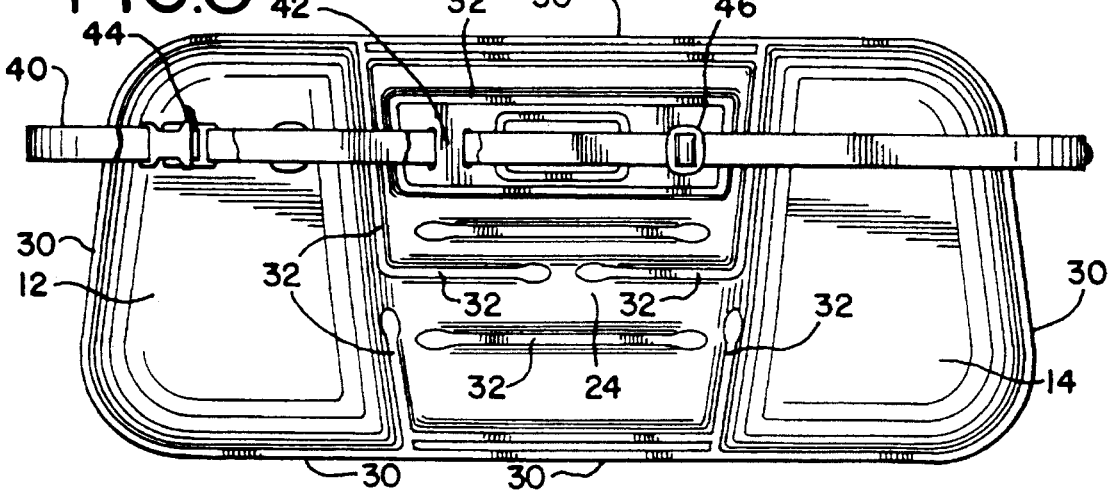

INFLATABLE PILLOW

FIELD OF THE INVENTION

This invention relates to an inflatable pillow that can be readily secured to a back support to provide a cushion for a user's head regardless of its resting position.

BACKGROUND OF THE INVENTION

The present invention relates to an inflatable pillow which in its non-inflatable stage is a very compact item that can be readily stored in a small area when not in use. There have been inflatable pillows used prior to applicant's novel invention, but these pillows were not capable of providing a fixed cushioned support regardless of the position of the head of the user resting on the pillow. Prior pillows of this type in addition to not providing a high degree of comfort for the user's head and neck were not adapted to be connected to a support such as a back rest which avoids the common problem of the pillow being displaced during usage, thus resulting in discomfort to the user resulting from such dislocation. Previously used pillows also did not provide for a continuous fixed cushioned support for the user's neck portion as well as the head resting portion when the head of the user moves from side to side. The lack of firm positioning of the pillow during usage and the particular cushioning features necessary to provide complete comfort during use presented disadvantages which are overcome by the present invention.

SUMMARY OF THE INVENTION

In accordance with the present invention, there is provided a pillow that provides an extremely comfortable head and neck rest for the users regardless of the position in which the users find themselves during their resting mode. The novel pillow provides full support for the user whether the head is located in a frontal or in a side position. The cradle support of the pillow permits free movement by the user but continues to provide a complete cushion support when the user moves from side to side during resting. To more fully accommodate the user, the end portions of the pillow are inflated to several times that of the intermediate portion, with the result that the head is firmly supported in a fixed cradled position while resting on cushioned inflatable end and intermediate sections.

In a preferred embodiment, the end sections of the pillow that are approximately 4"×8" are inflated to approximately a three inch thickness and the intermediate section is inflated to approximately one and one-quarter inches. The overall shape is essentially rectangular having a width of approximately 15 inches and a height of about 8 inches. These dimensions are merely exemplary and they can be varied as desired. The intermediate portion is tapered to provide better support and is generally trapezoidal in shape with the longer portion of approximately 8 inches in width being located at its upper section and tapered toward the lower section which is approximately six inches in width. The inflatable intermediate section provides a cushioned support for the neck while permitting a full range of head movement.

As aforementioned, when not in use, the pillow takes a flat, generally rectangular shape and thus can be stored in a very small space making it very adaptable to carry for subsequent airplane, car or bus trips.

In one of the end sections, there is provided a simple flap valve mechanism that includes a tubular portion and a valve closure secured thereto for controlling the flow of air into and out of the pillow. The end sections are interconnected by passageways formed in the intermediate section, with the result that the end sections as well as the intermediate sections are immediately inflated when air is introduced into the pillow. After being inflated to the prescribed amount the valve is closed off to prevent air from escaping. Thus, it can be seen inflation and deflation is quick and easy.

The back portion of the intermediate section provides loops through which extends a strap incorporating an adjustable buckle arrangement that permits the pillow to be readily connected to most any size seat support. When the pillow is to be affixed to a seat, the strap is merely wrapped around the upper portion of the seat and tightened to retain the pillow in position. When the pillow is no longer to be used the valve is opened with the air escaping and the pillow compressed into a small area and stored.

BRIEF DESCRIPTION OF THE DRAWINGS

FIG. 1 is a perspective view of an inflatable pillow assemblage mounted on a seat back;

FIG. 2 is a front view of the pillow; and

FIG. 3 is a rear view of the pillow, partially broken away to show the buckle arrangement and the strap connection to the pillow.

DESCRIPTION OF A PREFERRED EMBODIMENT

Referring to FIG. 1, there is shown a pillow 10 including inflatable end sections 12, 14 and an intermediate section 16 strapped to the back of seat 17. To inflate the pillow, a valve 18 including a tubular portion 20 and a sealing cap 22 connected to the tubular portion 20 is located in the lower right-hand corner of the front of the pillow (see FIG. 2). The inflatable sections 12 and 14 are connected by a passageway 24 so that both end sections 12, 14 are immediately inflated when air is introduced through the tube 20. It is noted that there are sealed portions 30 located around the perimeter of the pillow as well as intermediate sealed portions 32 that function to control the air flow within the pillow and define the various inflated and deflated areas.

As seen in FIG. 1, several of the sealed portions 32 define transversely extending spaced inflatable sections 33 that provide support for the user's neck when the pillow is in use. The upper portion of the intermediate section 16 includes a generally flat portion 34 which is defined by a generally rectangular seal 32. Located intermediate the section 34 is a smaller rectangularly sealed area 35.

The pillow 10 is connected to the seat back 17 by a strap 40 which extends through loops 42 formed in the panel section 34. The strap 42 is connected by a buckle 44 and the length of the strap can be varied by changing the overlapped portions of the strap through the buckle 46.

Thus, when the pillow is to be used it is inflated by introducing air through the tube 20 to the inflated condition shown in FIG. 1 and then wrapping the strap 40 around the seat back 27 to locate it in position.

It is intended to cover by the appended claims all such modifications and embodiments that fall within the scope thereof.

What is claimed is:

1. An inflatable pillow adapted to be connected to a seat comprising relatively large inflatable end sections and an intermediate section that is generally trapezoidal in shape with a larger upper portion and a smaller lower portion to accommodate free movement of the user's head portion, which intermediate section is inflatable to a fraction of the size of the end sections and adapted to receive a resting head between said end sections, valve means secured to said pillow to control the air flow to said pillow, the intermediate section defining passage means interconnecting said end sections to permit simultaneous enlargement of said end sections when air is introduced into said pillow through said valve means, and adjustable strap means connected to said pillow for securing the pillow to a seat to support the pillow in place while being used.

2. A pillow as set forth in claim 1 in which the end sections are also generally trapezoidal which has an upper portion that is smaller than its lower portion whereby the pillow is generally rectangular in shape.

* * * * *